US007156668B1

(12) United States Patent
Gherardini

(10) Patent No.: US 7,156,668 B1
(45) Date of Patent: Jan. 2, 2007

(54) PCB RETENTION MECHANISM

(75) Inventor: Stephen D. Gherardini, Harrisburg, PA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/292,529

(22) Filed: Dec. 2, 2005

(51) Int. Cl.
*H01R 12/00* (2006.01)

(52) U.S. Cl. ..... 439/76.1; 439/325

(58) Field of Classification Search ..... 439/325, 439/581, 630, 76.1
See application file for complete search history.

(56) References Cited

U.S. PATENT DOCUMENTS

| | | | | |
|---|---|---|---|---|
| 4,417,778 | A | 11/1983 | Halvorsen et al. | |
| 4,521,065 | A | 6/1985 | Nestor et al. | |
| 4,526,433 | A | 7/1985 | Tanaka | |
| 4,712,848 | A | 12/1987 | Edgley | |
| 4,717,218 | A | 1/1988 | Ratcliff | |
| 5,000,694 | A * | 3/1991 | Komatsu | 439/260 |
| 5,037,309 | A | 8/1991 | Abe et al. | |
| 5,044,963 | A | 9/1991 | Kukkonen et al. | |
| 5,160,275 | A | 11/1992 | Nakamura et al. | |
| 5,218,519 | A | 6/1993 | Welch et al. | |
| 5,319,524 | A | 6/1994 | Welch et al. | |
| 5,645,440 | A * | 7/1997 | Tobler et al. | 439/160 |
| 5,689,405 | A | 11/1997 | Bethurum | |
| 5,934,925 | A * | 8/1999 | Tobler et al. | 439/325 |
| 6,048,212 | A | 4/2000 | Stauble et al. | |
| 6,123,550 | A | 9/2000 | Burkert et al. | |
| 6,152,754 | A * | 11/2000 | Gerhardt et al. | 439/325 |
| 6,162,083 | A | 12/2000 | Seto | |
| 6,767,235 | B1 | 7/2004 | Wu | |
| 6,802,742 | B1 * | 10/2004 | Chaillie | 439/630 |

* cited by examiner

*Primary Examiner*—Tulsidas C. Patel
*Assistant Examiner*—Harshad C Patel
(74) *Attorney, Agent, or Firm*—Peter Van Winkle

(57) ABSTRACT

A circuit board (14) is installed and locked in place in a connector housing (12) which has a board-receiving slot (24) defined by side guides (44, 46) that closely engage upper and lower surfaces of the board during its forward insertion into the slot. The front portion of the board has a through aperture (50), and the housing has a ramp (52) that can fit into the aperture. As the forwardly-sliding board approaches a fully installed position, the ramp bends the front portion of the board as it rides up the ramp, until the aperture walls snap around the ramp and the board front portion unbends. The board can be slid backward out of the slot, only by bending up the board front portion and sliding it rearward.

8 Claims, 3 Drawing Sheets

PCB RETENTION MECHANISM

BACKGROUND OF THE INVENTION

A small circuit board or part of a larger circuit board, can be installed in a connector housing by simply laying the board on a housing surface. The board can be locked in place by drilling holes in the board and housing and inserting fasteners through the holes, or by forming the housing with upstanding posts that fit into drilled holes in the board, followed by deformation of the tops of the posts. The plastic housing may have to be molded in two pieces to captivate the board, or require a complex mold. It is possible to provide a slot into which the front end of the board slides in order to engage contacts, but the board still has to be locked in position.

The connector housing is commonly manufactured in large quantities by a connector manufacturer, while the circuit board is commonly made in smaller quantities by another company that designs its own circuit board and mounts it in the connector. A connector housing and circuit board combination that enabled easy installation and locking of the board in the housing, using a one-piece housing and not requiring any more effort to install than by simply sliding the board into place, would be of value.

SUMMARY OF THE INVENTION

In accordance with one embodiment of the invention, a connector housing and a circuit board are provided that enable the board to be installed in the housing by merely sliding the board forwardly into the housing. The board has a front portion with a through aperture therein, and the housing has a ramp that can fit in the aperture. As the forwardly-sliding board approaches a fully installed position, the ramp bends the front portion of the board as its rides up the ramp, until the aperture can snap down around the ramp. As the walls of the board aperture snap around the ramp, the board unbends, and ends up unbent but locked in the housing. The board is locked in the housing because the front end of the ramp abuts the front end of walls of the board aperture, thereby preventing the board from sliding rearward.

The housing has side guides at opposite sides of the board-receiving slot. The side guides include upper and lower side guides at each side of the housing, that lie closely adjacent to the board. The side guide resist pivoting of board as it rides up the ramp, thereby forcing bending of the front portion of the board. The fact that the board front portion has to bend up in order to slide rearwardly up the ramp, prevents accidental sliding out of the board, even in the event of vibrations and shocks. The front portion of the board is preferably much narrower than the middle portion of the board which is guided by the side guides. This assures that substantially all flexing occurs in the board front portion so there are no solder joint breaks in the rest of the board.

The housing is preferably a one piece molded part. The side guides include upper and lower guide elements that alternate along the length of each side, to enable molding using a mold that is not complex.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 2:
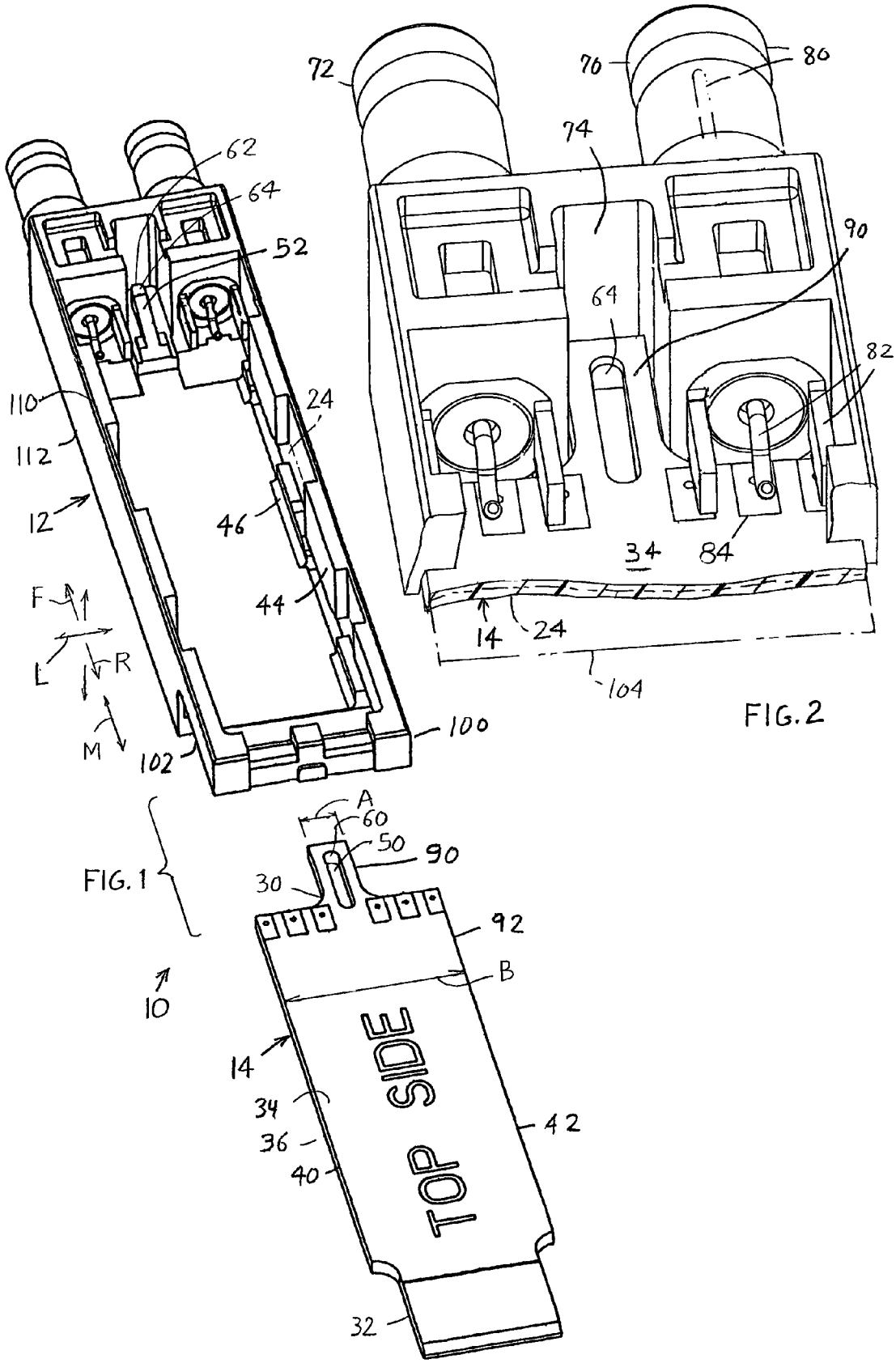
FIG. 1 is an exploded rear isometric view of the housing-and-board combination of the invention.
FIG. 2 is an isometric rear view of a portion of the combination of FIG. 1, with the board fully installed in the housing.
Figure 3:
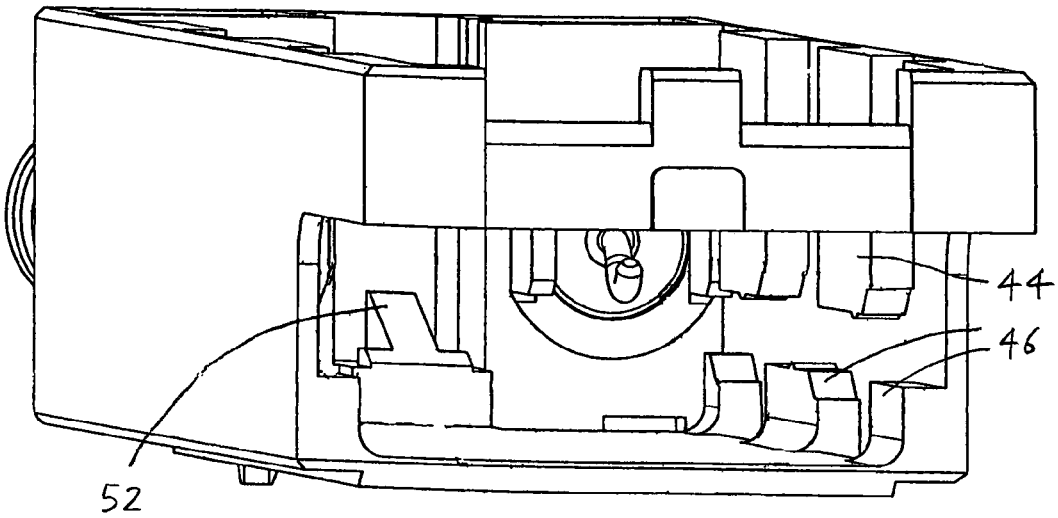
FIG. 3 is an isometric view taken from the rear of the connector of FIG. 1, without the board.

FIG. 1 illustrates a combination 10 of a connector housing 12 and a circuit board 14. The circuit board is shown as a small board, but it can be part of a large board device. The board 14 is installed in the housing by sliding the board forwardly F into the housing to cause the board to enter a card receiving slot 24 in the housing. In the following description, the board-receiving slot 24 is deemed to have the same shape and position as the fully installed board such as is shown at 14 in FIG. 2. The board has front and rear end portions 30, 32, top and bottom faces 34, 36, and laterally L opposite sides, or side edges 40, 42. The housing has upper and lower side guides 44, 46 at opposite sides of the board receiving slot, that guide the opposite side edges of the board as it slides in a forward longitudinal direction M into the housing.

Figure 5:
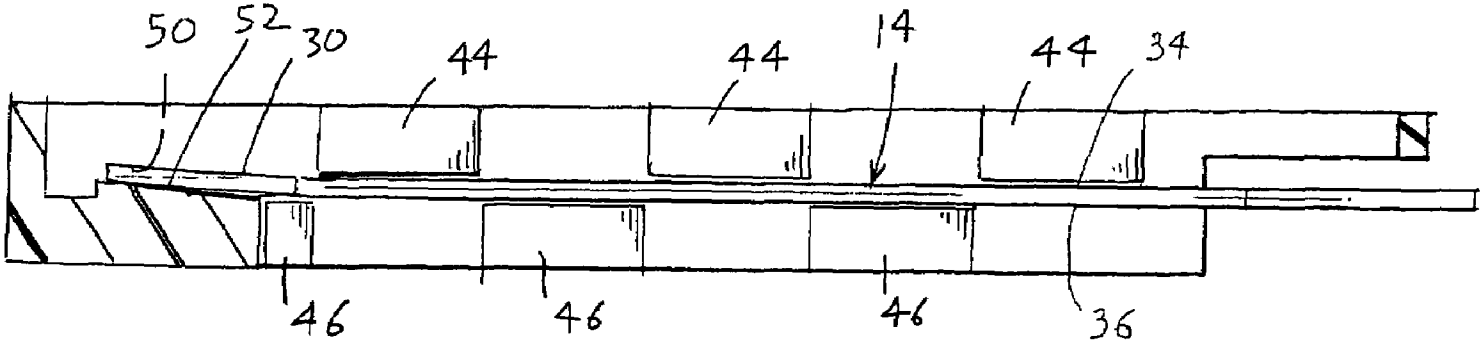
FIG. 5 is a simplified partial sectional view of the combination, showing the front portion of the board as it undergoes bending while approaching a fully installed position.

The front portion of the circuit board has a primarily vertical aperture 50, which is preferably elongated in longitudinal directions. The housing has a ramp 52 at the front portion of the board-receiving slot 24. The ramp is preferably also elongated in the forward-rearward directions. As the board is slid forward and lies close to the fully installed position as shown in FIG. 5, the front portion 30 of the board is bent slightly upward as it moves forward up the ramp 52. The board cannot simply tilt without bending as its front portion rides up the ramp. This is because the upper and lower side guides 44, 46 lie closely adjacent to the top and bottom of the board and to the board-receiving slot as the board slides along the slot. The upper and lower guides are sufficiently close to the board top and bottom faces to allow board tilt about a lateral axis by only about 1°, but it would require about a 3° tilt to avoid board bending as the board front portion rides up the ramp. This assures that the board front portion must bend, in addition to any board tilting, in order to ride up the ramp. The board front portion has sufficient resilience to take the bend and then spring back.

Figure 6:
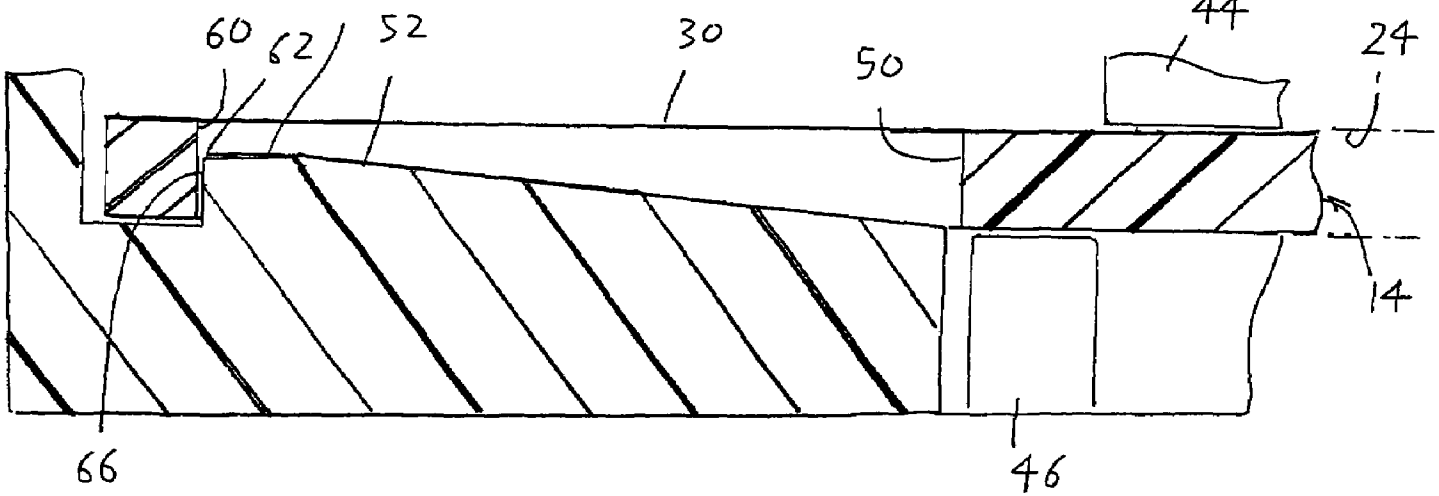
FIG. 6 is a simplified partial sectional view of the combination of FIG. 5, after the board front portion has reached its fully installed position.

As the bent board reaches its fully installed position, the front end 60 of the aperture, shown in FIG. 6, reaches the front end 62 of the ramp, which allows the board front portion to snap down so the board is now unbent. It is desirable that the board remain unbent, that is, bent only slightly or not at all during long periods of use or storage, to avoid fatigue damage to the board. The fully installed board cannot be slid rearward R without first lifting the board front portion sufficiently, that the lower face of the board lies at least as high as the top 64 of the ramp. The front face 66 of the ramp is primarily vertical, to form a stop that prevents the board from sliding up the ramp when the board is pulled rearward. The upper and lower side guides assure that the board must bend in order that the board front portion reaches the lifted position of its front end. It requires a considerable upward force to bend up the board front portion. Accordingly, the board is locked in its fully installed position.

The connector shown in FIG. 2 has a pair of coaxial connectors 70, 72 extending though the connector front wall 74. Each coaxial connector has contacts with a front mating end 80 and a rear termination end 82. The termination ends are soldered to conductive traces 84 on the front portion of the circuit board (or have cantilevered end press thereagainst), and the contact termination ends 82 lie vertically close (preferably within 0.5 mm) to the height of the upper face of the fully installed board to facilitate such soldering. The board front portion has a narrow tab 90 that projects forward from a wider middle portion 92 of the board. The board middle portion 92 (FIG. 1) has the same lateral width as the board-receiving slot. The board middle portion 92 engages the upper and lower side guides of the connector. The narrow tab 90 has a much narrower lateral width A than the width B of the board middle portion, with the tab width A preferably being less than half the middle portion width B. This allows the tab to bend with minimal bending of the rest of the boards when the extreme front end of the board tab encounters the ramp. The opposite sides of the board at the traces 84 do not bend up appreciably so they can slide under the contact rear termination ends.

Portions of the board lying rearward of the tab 90 may support components that are soldered to the board. If those board portions were to bend appreciably then there is danger of damage to the solder joints. The narrow tab 90 avoids such bending. It would be possible to reduce the thickness of the board front portion, but this adds to cost.

FIG. 2 shows that the top 64 of the ramp lies no higher than the top face 34 of the board, and preferably lies below the top face 34 of the board. This minimizes the amount of board bending required for the bottom of the board to reach the height of the ramp top 64, and is sufficient to reliably lock the board in its fully installed position.

Figure 4:
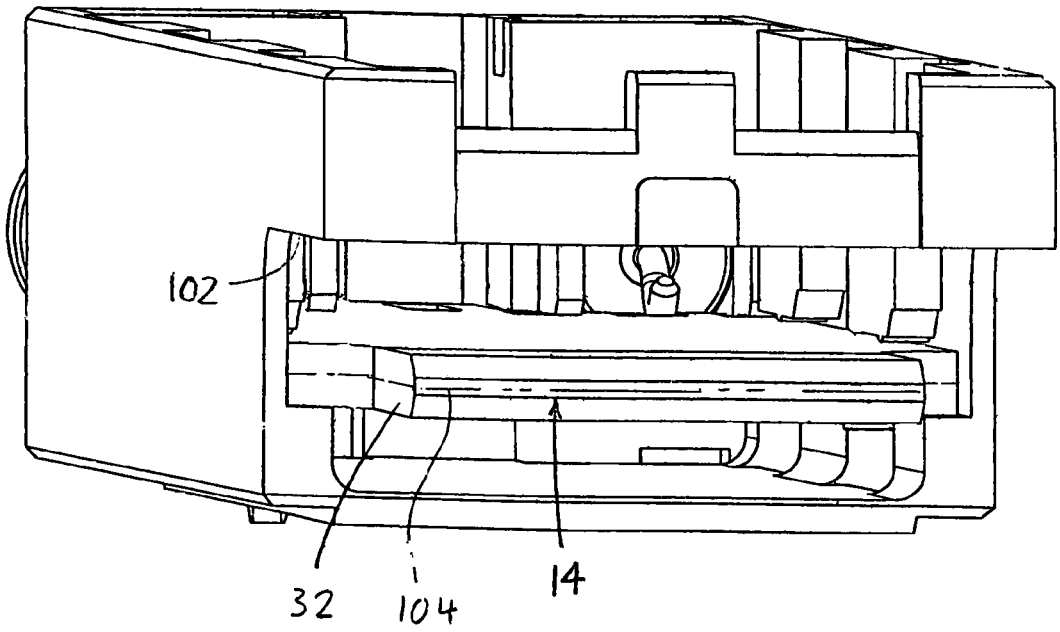
FIG. 4 is a view similar to that of FIG. 3, but with the board fully installed in the housing.

FIG. 1 shows that the rear portion 100 of the housing has a bottom that is cut away at 102. FIG. 4 shows that the cutaway 102 extends above and below the board-receiving slot and above and below the centerplane 104 of the board 14. The rear portion 32 of the fully installed board lies in the cutaway 102. This allows a person to more easily install or remove the board, while the rear portion of the board is partially concealed and protected from damage.

The connector can be molded of plastic as a single piece. The upper and lower side guides 44, 46 (FIG. 1) are staggered along each side of the slot. An upper mold part molds all of the upper side guides 44 (FIG. 1) except their lower surfaces and molds the upper surface of the lower side guides. A lower mold part molds the lower side guides 46 except their upper surfaces and also molds the lower surfaces of the upper side guides. The top portion 110 of the housing that lies above the board-receiving slot is open and slots are formed in the bottom (later filled in) to form the side guides.

Although terms such as "top" and "bottom" have been used to describe the invention as it is illustrated, it should be noted that the invention can be used in any orientation.

Thus, the invention provides a combination of a connector housing and a circuit board, which enables the board to be easily installed in the connector housing, using a simple and low cost connector housing. The housing has a board-receiving slot and has side guides that closely guide the board in forward sliding into the slot. The board has a front portion with an aperture and the front portion of the connector has a ramp that bends the board front portion until the aperture snaps around the ramp. It would be possible to place an aperture or slot(s) in places other than the middle of the front end of the board, such as at the rear of the board, and place the ramp accordingly, but placing the ramp and aperture at the front is highly desirable.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A combination of a connector device that includes a housing with front and rear end portions, said housing having walls forming a board-receiving slot and having guides that include side guides lying at laterally opposite sides of the slot, said combination including a circuit board that has top and bottom faces, said board having front and rear end portions and laterally opposite sides and said board being mountable on the housing by sliding the board forwardly into the housing while the board opposite sides are guided by said side guides, wherein:

said side guides lie closely adjacent to said upper and lower board faces to limit tilting of the board about a lateral axis that would raise the board front portion;

said board front portion is resiliently upwardly bendable;

said guides include a ramp fixed to said housing and positioned to upwardly deflect said front portion of said board during forward sliding of the board into said housing, said ramp being positioned to allow the board to unbend when the board reaches a fully installed position, and said housing forms a stop that prevents rearward sliding of the board when it has reached said fully installed position.

2. The combination described in claim 1 wherein:

said ramp has a small enough height that it extends only partially through said aperture, to thereby minimize the amount of bending of the board front portion.

3. A combination of a housing and a circuit board of predetermined size, which has a wide middle portion with laterally opposite side and board front and rear portions, wherein:

said housing has upper and lower guides that closely guide said middle portion of said circuit board in forward sliding into said housing to limit tilting of the circuit board middle portion about a lateral axis that would raise the board front portion, to no more than about 1°;

said board a front portion is easily bendable and said front portion has an aperture therein that has an aperture front end;

said housing front portion forms a ramp having an upper surface that extends at a forward-upward incline, the ramp being positioned to engage a lower face of said front portion of the board and bend the front portion of the board upwardly, said ramp having a front end and said board front portion being free to move down when said aperture front end moves forward of said ramp front end.

4. The combination described in claim 3 wherein:

said ramp has a ramp top that lies lower than the top of said aperture in said board front portion, to thereby minimize the amount of bending of the board front portion.

5. A combination of a connector device that includes a housing with front and rear end portions, said housing having walls forming a board-receiving slot and having guides that include side guides lying at opposite sides of the slot, said combination including a circuit board that has top and bottom faces, said board having front and rear end portions and opposite sides and said board being mountable on the housing by sliding the board forwardly into the housing while the board opposite sides are guided by said side guides, wherein:

said side guides lie closely adjacent to said upper and lower board faces to limit tilting of the board;

said board front portion is resiliently upwardly bendable;

said guides include a ramp fixed to said housing and positioned to upwardly deflect said front portion of said board during forward sliding of the board into said housing, said ramp being positioned to allow the board to unbend when the board reaches a fully installed position, and said housing forms a stop that prevents rearward sliding of the board when it has reached said fully installed position;

said board front end portion is in the form of a tab with an aperture therein that has a front end (60);

said board has a middle portion of a width (B) and said tab has an average width (A) rearward of said aperture front end (60) which is less than half said middle portion width (B).

6. A combination of a connector device that includes a housing with front and rear end portions, said housing having walls forming a board-receiving slot and having guides that include side guides lying at opposite sides of the slot, said combination including a circuit board that has top and bottom faces, said board having front and rear end portions and opposite sides and said board being mountable on the housing by sliding the board forwardly into the housing while the board opposite sides are guided by said side guides, wherein:

said side guides lie closely adjacent to said upper and lower board faces to limit tilting of the board;

said board front portion is resiliently upwardly bendable;

said guides include a ramp fixed to said housing and positioned to upwardly deflect said front portion of said board during forward sliding of the board into said housing, said ramp being positioned to allow the board to unbend when the board reaches a fully installed position, and said housing forms a stop that prevents rearward sliding of the board when it has reached said fully installed position;

said housing rear end portion lies above said board rear portion, and said housing rear end portion is completely cut away (102) at a height below the top of said board-receiving slot, so the housing rear portion includes only a top rear portion part (100) that lies above the top of said board-receiving slot, to thereby facilitate board insertion and conceal the board rear portion, said board having a rear end that projects rearward no further than said top rear portion part (100).

7. A combination of a housing and a circuit board of predetermined size, which has a wide middle portion, wherein:

said housing has upper and lower guides that closely guide said middle portion of said circuit board in forward sliding into said housing to limit tilting of the circuit board middle portion to no more than about 1°;

said board has an easily bendable front portion with an aperture therein that has an aperture front end;

said housing front portion forms a ramp having an upper surface that extends at a forward-upward incline, the ramp being positioned to engage a lower face of said front portion of the board and bend the front portion of the board upwardly, said ramp having a front end and said board front portion being free to move down when said aperture front end moves forward of said ramp front end;

said aperture in said board front portion has front and rear aperture ends and has an aperture middle lying halfway between said front and rear ends, said board front portion has a part lying rearward of said aperture middle that is narrower than said board middle portion.

8. A combination of a housing and a circuit board of predetermined size, which has a wide middle portion, wherein:

said housing has upper and lower guides that closely guide said middle portion of said circuit board in forward sliding into said housing to limit tilting of the circuit board middle portion to no more than about 1°;

said board has an easily bendable front portion with an aperture therein that has an aperture front end;

said housing front portion forms a ramp having an upper surface that extends at a forward-upward incline, the ramp being positioned to engage a lower face of said front portion of the board and bend the front portion of the board upwardly, said ramp having a front end and said board front portion being free to move down when said aperture front end moves forward of said ramp front end;

said board front portion forms an elongated tab having a width along a majority of its front-to-rear length that is less than half the width of said board middle portion.

* * * * *